US008721981B2

(12) United States Patent
Freund et al.

(10) Patent No.: US 8,721,981 B2
(45) Date of Patent: May 13, 2014

(54) SPIRAL RECUPERATIVE HEAT EXCHANGING SYSTEM

(75) Inventors: Sebastian Walter Freund, Munich (DE); Gabriel Rojas Kopeinig, Innsbruck (AT)

(73) Assignee: General Electric Company, Niskayuna, NY (US)

( * ) Notice: Subject to any disclaimer, the term of this patent is extended or adjusted under 35 U.S.C. 154(b) by 1080 days.

(21) Appl. No.: 12/627,059

(22) Filed: Nov. 30, 2009

(65) Prior Publication Data

US 2011/0127021 A1 Jun. 2, 2011

(51) Int. Cl.
*B01J 19/00* (2006.01)
*F28D 9/04* (2006.01)

(52) U.S. Cl.
USPC ..... 422/198; 422/202; 422/203; 422/205; 422/206; 165/164; 165/DIG. 54; 165/DIG. 398

(58) Field of Classification Search
CPC ..... F28D 9/04
USPC ..... 422/203, 206; 165/DIG. 398
See application file for complete search history.

(56) References Cited

U.S. PATENT DOCUMENTS

| | | | | |
|---|---|---|---|---|
| 4,546,826 | A | 10/1985 | Zitzmann | |
| 4,655,174 | A | 4/1987 | Fillios | |
| 4,679,621 | A | 7/1987 | Michele | |
| 4,883,117 | A | 11/1989 | Dobbs et al. | |
| 4,911,894 | A * | 3/1990 | Retallick et al. | 422/174 |
| 5,252,299 | A * | 10/1993 | Retallick | 422/174 |
| 5,922,178 | A * | 7/1999 | Isenberg | 204/265 |
| 6,190,624 | B1 | 2/2001 | Romatier | |
| 6,532,339 | B1 | 3/2003 | Edgar et al. | |
| 6,935,105 | B1 * | 8/2005 | Page et al. | 60/298 |
| 2008/0202736 | A1 | 8/2008 | Specht | |
| 2008/0271448 | A1 | 11/2008 | Evans-Beauchamp | |
| 2009/0114380 | A1 | 5/2009 | Grabon | |

FOREIGN PATENT DOCUMENTS

| | | | |
|---|---|---|---|
| DE | 19909180 | A1 * | 9/1999 |
| JP | 2002349968 | A | 12/2002 |
| WO | 9207226 | A | 4/1992 |

OTHER PUBLICATIONS

Machine translation of DE 19909180 A1 (Sep. 1999).*

Mark R. Strenger, Stuart W. Churchill, William B. Retallick; Abstract : Operational characteristics of a double-spiral heat exchanger for the catalytic incineration of contaminated air; Ind. Eng. Chem. Res., 1990, 29 (9); 3 Pages.

Compact Spiral Heat Exchangers; URL : http://www.spiralheatexchangers.ca/; 3 Pages, Retrieved on Nov. 30, 2009.

European Search Report and Written Opinion issued in connection with corresponding PCT Application No. 10191410.9-1605 dated Nov. 20, 2013.

* cited by examiner

*Primary Examiner* — Jennifer A Leung
(74) *Attorney, Agent, or Firm* — Ann M. Agosti

(57) ABSTRACT

A heat exchanging system is provided. The heat exchanging system includes multiple plates wound spirally around a reaction chamber. The multiple plates also form multiple channels that operate as a counter flow recuperator terminating within the reaction chamber.

18 Claims, 5 Drawing Sheets

SPIRAL RECUPERATIVE HEAT EXCHANGING SYSTEM

BACKGROUND

The invention relates generally to heat exchanging systems and more particularly, to spiral recuperative heat exchanging systems.

Heat exchanging systems are used for efficient heat transfer from one medium to another. The heat exchanging systems are widely used in applications such as space heating, refrigeration, air conditioning, power plants, chemical plants, petrochemical plants, petroleum refineries, and natural gas processing. In general, heat exchanging systems are classified according to their flow arrangement as parallel heat exchanging systems and counter flow heat exchanging systems. In the counter flow heat exchangers, fluids at different temperatures enter the heat exchanger from opposite ends while in the parallel heat exchanging systems the fluids at different temperatures enter from the same direction.

A typical example of a counter flow heat exchanger is a spiral heat exchanger. The spiral heat exchanger may include a pair of flat surfaces that are coiled to form two channels in a counter flow arrangement. The two channels provide a heat exchanging surface to the two fluids. It is generally known that an amount of heat exchanged is directly proportional to the surface area of the heat-exchanging surface. In spiral heat exchangers, the length of the two channels is increased to enhance the surface area of the heat exchanging surface. The enhanced surface area of the heat exchanging surface can lead to an undesirably large size of the heat exchanger. Further, the increase in the length of the two channels results in a longer flow path for the fluid. The longer flow path results in pressure losses of the fluid flowing via the two channels.

On the other hand, maintaining a smaller size of the current spiral heat exchangers results in a smaller length of the two channels, leading to a reduced heat exchanging surface. Consequently, this results in an undesirable efficiency of the heat exchanger.

Furthermore, certain spiral heat exchangers employ reaction chambers for thermal treatment of the gases. Typically, the reaction chambers are disposed partially inside or entirely outside the spiral heat exchangers. In such a structural configuration, the reaction chambers and the spiral heat exchangers are generally connected via tubes. The tubes provide a flow path to the fluid from the spiral heat exchanger to the reaction chamber. The flow path is provided to promote certain reactions within the fluids. The fluid flows from the spiral heat exchanger to the reaction chamber via the tubes resulting in dissipation of heat from the fluid to the environment. Thermal losses in the fluid result in reduction of efficiency of the spiral heat exchanger. In addition, the tubes need to be heavily insulated to reduce the dissipation of heat to the environment and to further reduce the thermal losses. However, providing insulation on the tubes results in undesirable costs of manufacturing the spiral heat exchanger.

Therefore, there is a need for an improved spiral heat exchanger to address one or more aforementioned issues.

BRIEF DESCRIPTION

In accordance with an embodiment of the invention, a heat exchanging system is provided. The heat exchanging system includes multiple plates wound spirally around a reaction chamber. The multiple plates form multiple channels that operate as a counter flow recuperator terminating within the reaction chamber.

In accordance with another embodiment of the invention, a reaction chamber is provided. The reaction chamber includes at least one movable internal header configured to facilitate thermal expansion of multiple plates wound spirally around the reaction chamber. The reaction chamber further includes at least one horizontal baffle configured to partition the at least one movable internal header thereby providing an inlet to an incoming gas flow and an outgoing vent to an outgoing gas flow within the reaction chamber.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed in detail below, embodiments of the present invention include an improved heat exchanging system that discloses a recuperator formed by multiple plates spirally wound around a reaction chamber disposed at a center of the recuperator. The multiple plates form multiple channels terminating within at least one movable internal header. The at least one movable internal header facilitates thermal expansion of the multiple plates forming the multiple channels.

Generally, heat exchanging systems are widely used in applications that emit a significant volume of contaminated waste exhaust fluids at high temperatures. Non-limiting examples of such applications include power plants, chemical plants, petrochemical plants, petroleum refineries, natural gas processing and turbine engines. The heat exchanging systems are incorporated in these applications to recover heat from the waste exhaust fluids. The heat exchanging systems recover heat from the waste exhaust fluids via a process of heat transfer. The heat transfer is a physical phenomenon that facilitates heat exchange between fluids at different temperatures through a conducting wall. The heat exchanging systems work on the phenomena of heat transfer to recover heat from the waste exhaust fluids. The heat exchanging systems have different modes of operation based on the design of the heat exchanging systems. The heat exchanging systems are typically classified according to the operation of the heat exchanging system. Common forms of heat exchanging systems include parallel flow heat exchangers and counter flow heat exchangers. Fluids flow within enclosed surfaces in the heat exchanging systems, with the enclosed surfaces providing direction and flow path to the fluids. Typically, a waste exhaust fluid from a waste exhaust fluid emitting source and a second fluid required to be heated, flow within adjacent enclosed surfaces to exchange heat. For example, in parallel heat exchangers, the flow of the waste exhaust fluid and the second fluid within the adjacent enclosed surfaces is parallel to each other. The heat is exchanged between the waste exhaust fluid and the second fluid during the parallel flow within the parallel heat exchanging system. Similarly, in counter flow heat exchangers, the flow of the waste exhaust fluid and the second fluid is opposite to each other. The waste exhaust fluid and the second fluid enter from opposite ends of adjacent enclosed surfaces.

Figure 1:
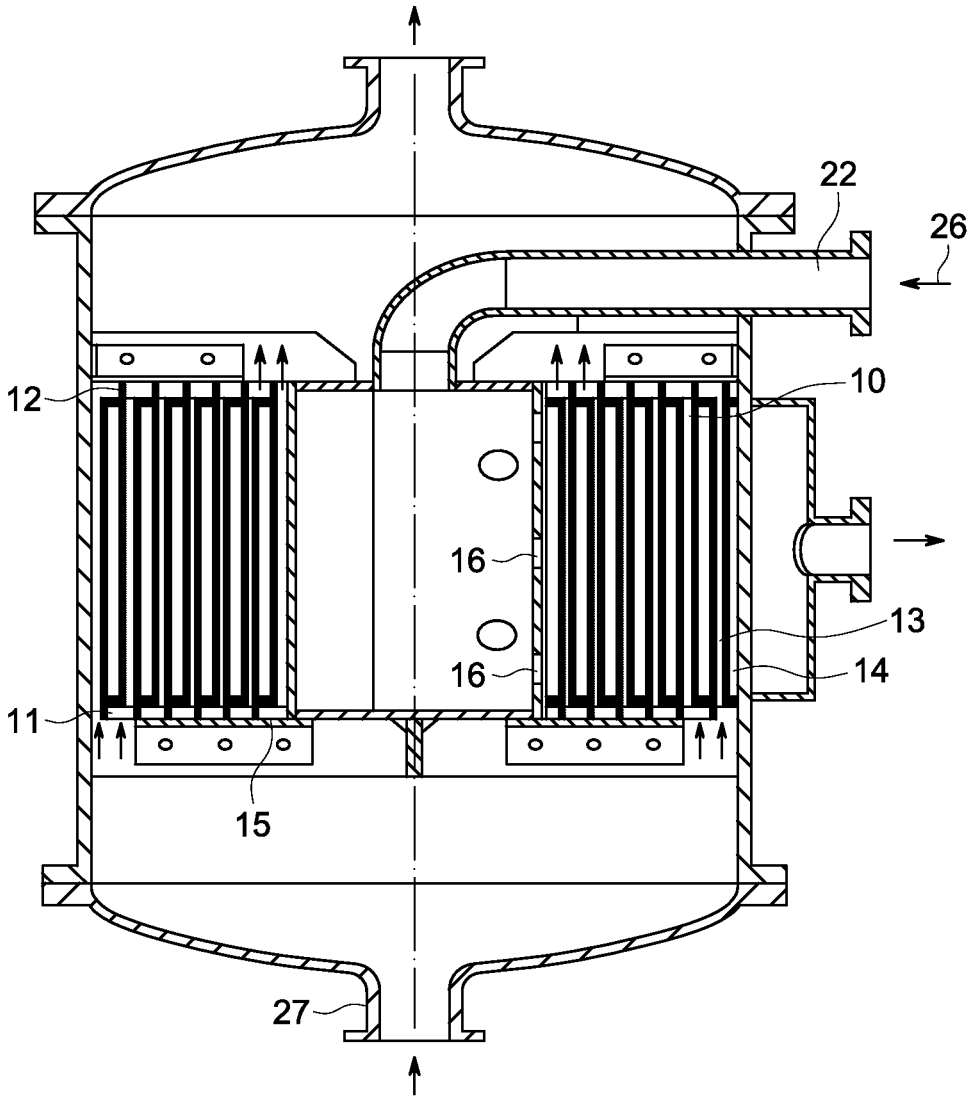
FIG. 1 (Prior Art)
FIG. 1 is a diagrammatic illustration of a spiral heat exchanger

A common form of counter flow heat exchanger is a spiral heat exchanger. The spiral heat exchanger includes spirally shaped channels. The spirally shaped channels form a double spiral within the heat exchanging system. Spiral shaped channels enclosed by surfaces form a flow path for the first fluid and the second fluid in the spiral heat exchanger. The waste exhaust fluid and the second fluid enter the adjacent spiral enclosed surfaces from opposite ends and flow via the flow path. The waste exhaust fluid and the second fluid exchange heat during the flow within the spiral enclosed surfaces. Turning to drawings, FIG. 1 is a diagrammatic illustration of such a conventional spiral heat exchanger 10. The spiral heat exchanger 10 includes two plates 11 and 12 that form two separate spiral enclosed surfaces. The two plates 11 and 12 provide flow paths 13 and 14 respectively. A waste exhaust fluid 26 is introduced in the flow path 14 via an inlet 16 connected to a supply conduit 22. The supply conduit 22 is attached to the waste exhaust fluid emitting source. The waste exhaust fluid 26 flows in the flow path 14 through the spiral heat exchanger 10. A second fluid 15 is introduced into the spiral heat exchanger 10 axially through an inlet opening 27 via two external turns of the flow path 13. Thus, the second fluid 15 flows in a counter current to the waste exhaust fluid 26.

One limitation of having only two flow paths 13 and 14 is that the capacity of the spiral heat exchanger to intake higher amounts of second fluid 15 is reduced and results in overall inefficiencies in the spiral heat exchanger 10. Furthermore, heating the second fluid 26 via counter flowing waste exhaust fluid 26 results in thermal expansion of the second fluid 15 and causes thermal stress on the spiral plates 11 and 12. The thermal stress results in a higher maintenance cost of the spiral heat exchanger 10.

Figure 2:
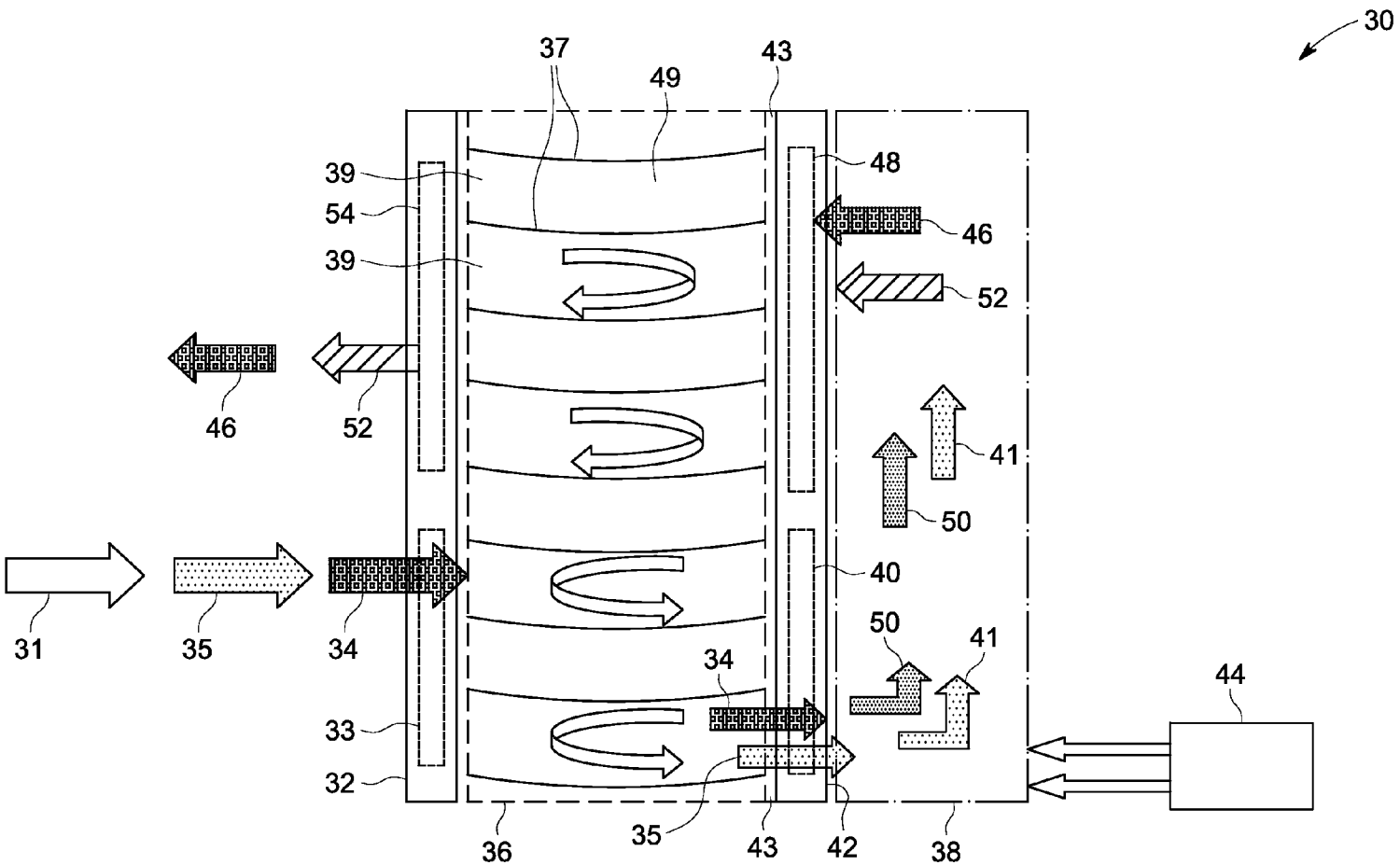
FIG. 2 is a schematic representation of an exemplary heat exchanging system in accordance with an embodiment of the invention.

In an illustrated embodiment of the invention as shown in FIG. 2, a schematic representation of a heat exchanging system 30 is depicted. An incoming gas flow 31 enters the heat exchanging system 30 via an external header 32 configured to provide an inlet 33 to the incoming gas flow 31. The incoming gas flow 31 is equivalent to the waste exhaust fluid 15 (FIG. 1) emitted from a waste exhaust fluid emitting source. In one embodiment of the invention, the heat exchanging system 30 includes a continuous flow of incoming gas flow 31. For the sake of simplicity and better understanding of heat transfer within the heat exchanging system 30, the continuous flow of incoming gas flow 31 has been divided to a first incoming gas flow 34 entering the heat exchanging system 30 at an initial instant of time and a second incoming gas flow 35 entering at a slightly later point of time.

The first incoming gas flow 34 enters the heat exchanging system 30 via the inlet 33 to a counter flow recuperator 36. The counter flow recuperator 36 is provided to recover the waste heat from the first incoming gas flow 34. The counter flow recuperator 36 includes multiple plates 37 wound spirally around a reaction chamber 38 such that the reaction chamber 38 is centrally disposed within the recuperator 36. The multiple plates 37 form multiple channels 39 that operate as a counter flow recuperator 36 terminating within the reaction chamber 38. Furthermore, the first incoming gas flow 34, flows within the spirally wound multiple channels 39 formed in the counter flow recuperator 36. The first incoming gas flow 34 enters the reaction chamber 38 via an inlet 40 and results in a first reacting gas flow 41. The inlet 40 is provided at an internal header 42 formed at a terminating end 43 of the multiple channels 39. The multiple channels 39 terminating within the reaction chamber 38 supply the first incoming gas flow 34 to the reaction chamber 38 via the inlet 40 at the internal header 42. The reaction chamber 38 is an enclosed space provided for the reacting gas flow 41 to undergo reactions. The reacting gas flow 41 is heated in the reaction chamber 38 to allow the oxidation of all oxidable components to form an outgoing gas flow within the reaction chamber 38.

In an initial stage of operation of the heat exchanging system 30 as shown in FIG. 2, the temperature of the first reacting gas flow 41 is not equivalent to a desirable temperature required to undergo reactions. Therefore, the first reacting gas flow 41 is externally heated to reach the desirable temperature for the first reacting gas flow 41 to undergo reactions. In an embodiment of the invention, a small amount of heating input may be required for continuous heating of the reaction chamber to the desirable temperatures. In an exemplary embodiment, a heating device 44 is provided for heating the reaction chamber 38 to the desirable temperature. In a particular embodiment, the heating device 44 is a fuel injector. In another embodiment, the heating device 44 is a heater. In yet another embodiment, the heating device 44 is a combination of both the fuel injector or heater or any other device capable of external heating. In one example, the desirable temperature includes about 700° C. to about 1000° C.

The first reacting gas flow 41 including oxidable pollutants is heated to the desirable temperature to substantially burn the unburnt hydrocarbons and allow reactions within the pollutants resulting in a first outgoing gas flow 46. The first outgoing gas flow 46 exits the reaction chamber 38 via an outlet 48 and enters the recuperator 36.

Similarly, at a later point of time, the second incoming gas flow 35 enters the recuperator via the inlet 33. The first outgoing gas flow 46 flowing within the recuperator 36 is at a higher temperature relative to that of the second incoming gas flow 35 flowing within the recuperator 36. The counter flowing second incoming gas flow 35 and the first outgoing gas flow 46 exchanges heat with each other within the recuperator 36. The heat is exchanged between the second incoming gas 35 and the first outgoing gas 46 via a surface 49 of the multiple channels 39 within the recuperator 36. The transfer of heat results in a recovery of heat from the first outgoing gas flow 46 to further heat the second incoming gas flow 35 to the desirable temperature required within the reaction chamber 38. Such a transfer of heat eliminates the usage of the external heating device 44 beyond the initial stage of operation. The second incoming gas flow 35 at the desirable temperature further enters the reaction chamber 38 to provide a second reacting gas flow 50. The second reacting gas flow 50 undergoes reactions and results in a second outgoing gas flow 52. The first outgoing gas flow 46 leaves the recuperator 36 via an outlet 54 at the external header 32 further exiting the heat exchanging system 30. Similarly, this process is repeated throughout the operation of the heat exchanging system 30.

Figure 3:
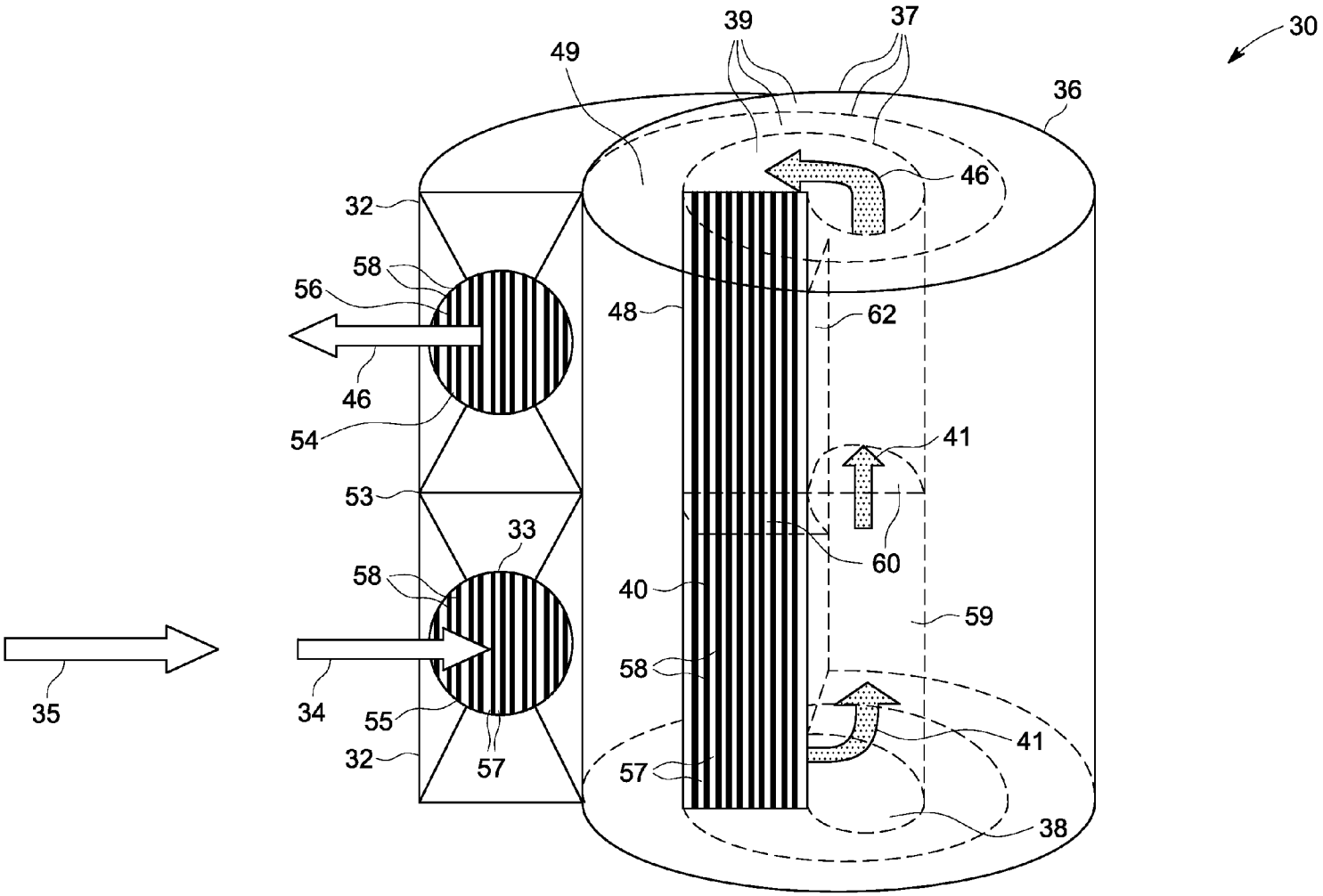
FIG. 3 is a diagrammatic illustration of the heat exchanging system in FIG. 2.

FIG. 3 is a perspective view of the heat exchanging system 30 in FIG. 2. The external header 32 (FIG. 2) is partitioned via a divider plate 53 to provide the inlet 33 to the first incoming gas flow 34 entering the recuperator 36 and the outlet 54 to the first outgoing gas flow 46 exiting the recuperator 36 respectively. In an exemplary embodiment, two header bonnets with flanges are attached on both sides of the divider plate 53. In a particular embodiment of the invention, the external header 32 is connected to a source of incoming gas 31. Furthermore, the external header 32 is coupled to multiple plates 37. The multiple plates 37 are wound spirally around the centrally disposed reaction chamber 38 to form multiple channels 39. The multiple channels 39 operate as a counter flow recuperator 36 and provide the heat exchanging surface 49 to the second incoming gas flow 35 and the first outgoing gas flow 46. In an embodiment of the invention, the multiple plates 37 are enclosed within a thick sheet metal for structural integrity. In another embodiment of the invention, a side cover is flanged or welded onto the thick metal sheet to close the multiple channels 39 and the reaction chamber 38 at both ends of the multiple channels 39. In yet another embodiment, the multiple channels 39 are alternatively closed at opposite ends 55 and 56 of multiple channels 39. A first set of alternate channels 57 are closed at the inlet 33. The incoming gas flow 31 enters the recuperator 36 via a second set of alternate channels 58 that are open at the inlet 33. In a particular embodiment of the invention, ends 55 and 56 of the multiple channels 39 are formed such that a plane cutting a cross sectional area of the ends 55 and 56 of the multiple channels 39 are oriented at an angle less than about 90° relative to the direction of the flow to increase cross-sectional flow area into or out of the ends 55 and 56 of the multiple channels 39 respectively.

An arrangement of the multiple plates 37 wound spirally around the centrally disposed reaction chamber 38 minimizes thermal losses and ensures a compact design. The multiple plates 37 and multiple channels 39 increase the overall efficiency of the heat exchanging system 30 as a greater amount of incoming gas 31 can be heated simultaneously compared to the conventional spiral heat exchanging system 10 (FIG. 1). Moreover, the size of the heat exchanging system 30 is reduced as multiple plates 37 are wound spirally around the centrally disposed reaction chamber 38. The size of the heat exchanging system 30 reduces as the reaction chamber 38 is disposed within the spirally wound multiple plates 37 compared to previously used larger spiral heat exchanging systems that provided a reaction chamber externally connected to the spiral heat exchanging system.

Furthermore, the reaction chamber 38 includes a void volume 59 provided for reaction of the first incoming gas 34 inside the reaction chamber 38. The reaction chamber 38 also includes at least one movable internal header 42. The multiple channels 39 terminate within the reaction chamber 38 to form the at least one movable internal header 42. The at least one movable internal header 42 is partitioned by at least one horizontal baffle 60 to provide the inlet 40 and the outgoing vent 48 within the reaction chamber 38. In an embodiment of the invention, the at least one horizontal baffle is perpendicular to the terminating end 43 of the multiple channels 39. The second set of alternate channels 58 is open at the inlet 40 and the first incoming gas 34 enters the reaction chamber 38 via the second set of alternate channels 58.

The reacting gas flow 41 (FIG. 2) is subjected to reactions at desirable temperatures in the void volume 59 within the reaction chamber 38. The reactions at desirable temperatures result in thermal expansion of the multiple plates 37 at the inlet 40 within the reaction chamber 38. In an exemplary embodiment, the at least one movable internal header 42 may not be fixed to the multiple plates 37 and may slide above the multiple plates 37 to facilitate thermal expansion of the multiple plates 37. Hence, the at least one movable internal header 42 reduces the thermal stress in the multiple plates 37.

The reaction chamber 38 further includes at least one vertical baffle 62 oriented parallel to the terminating end 43 of the plurality of channels 39. The at least one vertical baffle 62 is formed by the extension of the innermost channel wall disposed within the reaction chamber 38 and is configured to guide the flow of the first reacting gas flow 41 inside the reaction chamber 38. The at least one vertical baffle 62 mixes the first reacting gas flow 41 by increasing local velocity of the first reacting gas flow 41 inside the reaction chamber 38. The mixing of the reacting gas flow 41 provides enhanced reactions within the reaction chamber 38.

Figure 4:
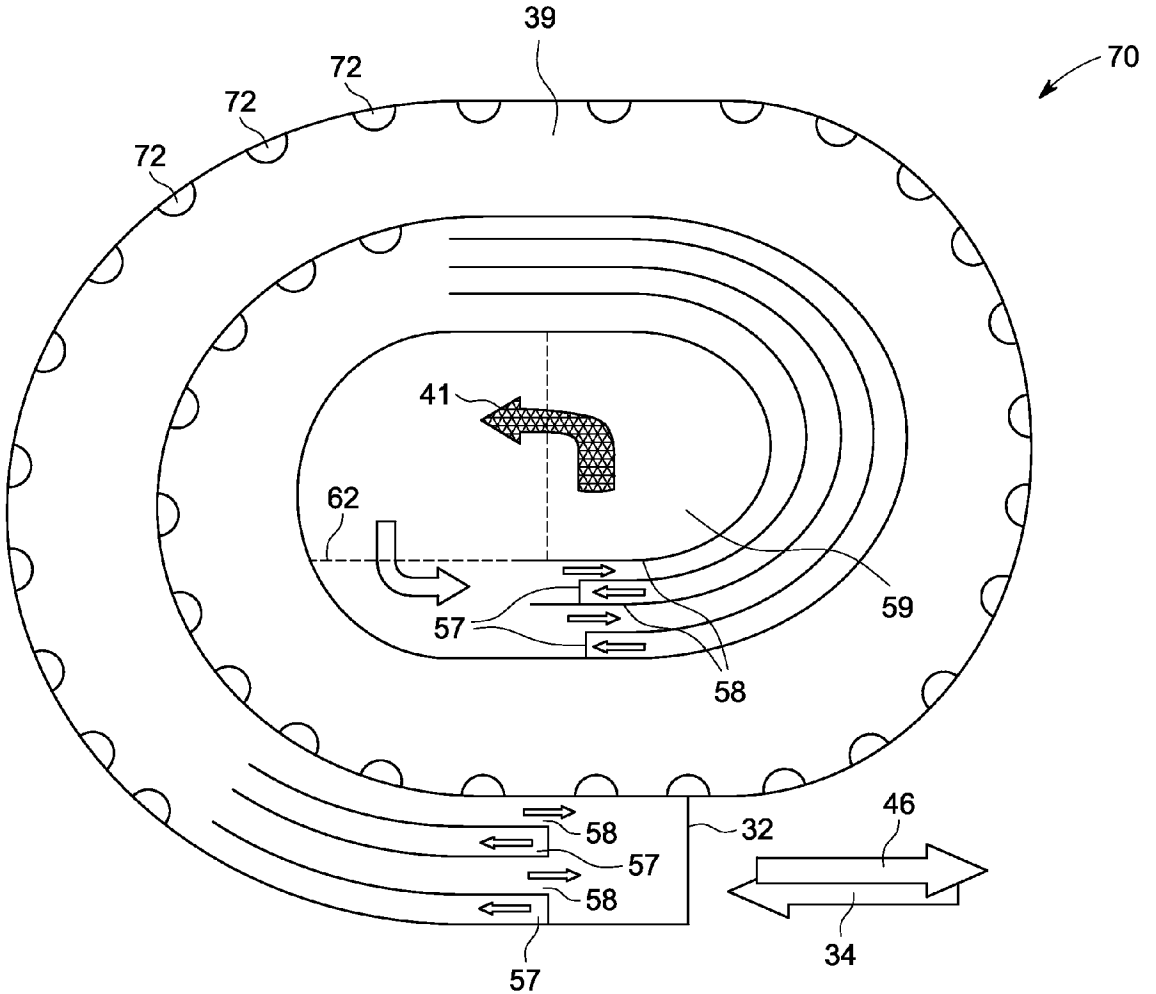
FIG. 4 is a schematic top cross sectional view of the heat exchanging system in FIG. 2.

In yet another embodiment of the invention as shown in FIG. 4, a schematic top cross-sectional view 70 of the heat exchanging system 30 in FIG. 2 is depicted. The multiple plates 37 provide the surface 49 (FIG. 2) for exchanging heat within the recuperator 36. In an embodiment of the invention, the multiple plates 37 include one or more corrugations or undulations on the surface 49 of the multiple plates 37. In another embodiment, the surface of the multiple plates 37 also includes protrusions 72. In an exemplary embodiment, the protrusions 72 include studs, pins or fins. The one or more corrugations, undulations and the protrusions 72 create irregularities on the surface of the multiple plates 37. The irregularities increase the surface area of the multiple plates 37. The irregularities also enhance turbulence within the first incoming gas flow 34 and the first outgoing gas flow 46. Therefore, the irregularities provide greater heat exchange between the second incoming gas flow 35 and the first outgoing gas flow 46 compared to a smooth surface in conventional heat exchanging systems. Furthermore, the one or more corrugations, undulations and the protrusions 72 also maintain channel gap and ensure mechanical rigidity of the multiple plates 37.

Figure 5:
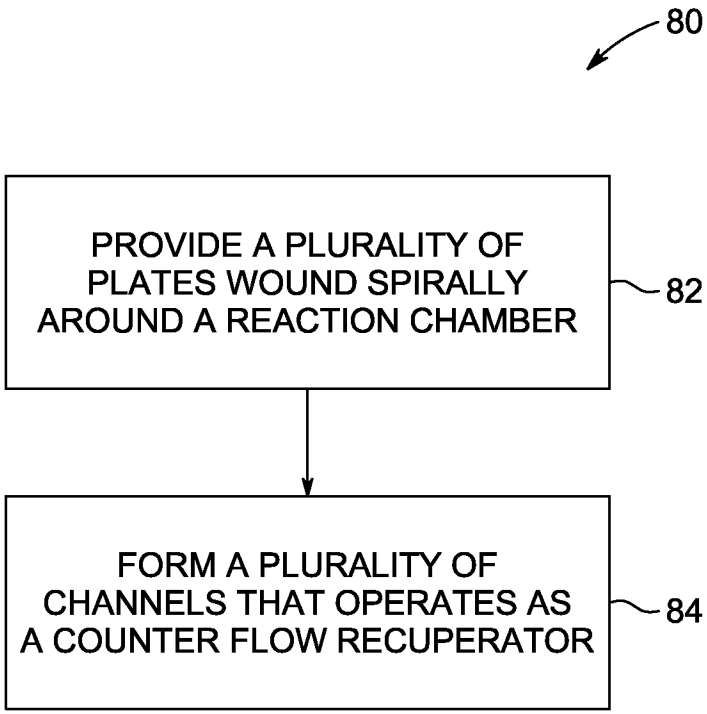
FIG. 5 is a flow chart representing steps involved in an exemplary method for providing a heat exchanging system in accordance with an embodiment of the invention.

FIG. 5 is a flow chart representing steps involved in an exemplary method 80 for providing a heat exchanging system. The method 80 includes providing multiple plates wound spirally around a reaction chamber in step 82. In a particular embodiment, one or more corrugations or undulations are formed on a surface of the multiple plates. In another embodiment, one or more protrusions are disposed on the surface of the multiple plates. The multiple plates form multiple channels that operate as a counter flow recuperator terminating within the reaction chamber in step 84. In an exemplary embodiment, at least one movable internal header is disposed within the reaction chamber to provide extra volume for thermal expansion of the reacting gas flowing within the chamber. In another embodiment, at least one external header is configured to provide an inlet to the incoming gas flow and an outlet to the outgoing gas flow entering and exiting the heat exchanging system respectively. In yet another embodiment, at least one horizontal baffle is configured to partition the at least one movable internal header thereby providing an inlet to the incoming gas flow and an outgoing vent to the outgoing gas flow within the reaction chamber. In another embodiment of the invention, at least one vertical baffle is oriented along a direction of flow of the reacting gas flow and guides the flow of the reacting gas flow inside the reaction chamber.

The various embodiments of a heat exchanging system described above provide a heat exchanging system with compact design, high efficiency and reliability. The heat exchanging system also incorporates innovative movable internal headers that reduce thermal stress on the heat exchanging system. Furthermore, the reaction chamber requires minimal insulation to provide negligible thermal losses. The minimal insulation reduces the cost of the heat exchanging system. These techniques and systems also allow for a greater surface area that enhances heat transfer within the recuperator.

Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

Furthermore, the skilled artisan will recognize the interchangeability of various features from different embodiments. For example, one or more corrugations or undulations on the surface of the multiple plates with respect to one embodiment can be adapted for use with an external heating device described with respect to another embodiment of the invention. Similarly, the various features described, as well as other known equivalents for each feature, can be mixed and matched by one of ordinary skill in this art to construct additional systems and techniques in accordance with principles of this disclosure.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A heat exchanging system comprising;

a plurality of plates wound spirally around a reaction chamber, forming a plurality of channels that operate as a counter flow recuperator terminating within the reaction chamber, wherein the reaction chamber comprises at least one horizontal baffle oriented perpendicular to a terminating end of the plurality of channels and configured to partition at least one movable internal header thereby providing an inlet to the incoming gas flow and an outgoing vent to the outgoing gas flow within the reaction chamber.

2. The system of claim 1, wherein the plurality of plates are parallel to each other.

3. The system of claim 1, wherein the plurality of plates comprise one or more corrugations or undulations on a surface.

4. The system of claim 3, wherein the plurality of plates comprise one or more protrusion on the surface.

5. The system of claim 4, wherein the protrusions comprise studs, pins or fins.

6. The system of claim 1, wherein the reaction chamber is centrally disposed relative to the plurality of plates.

7. The system of claim 1, comprising a heating device to heat the reaction chamber to a desirable temperature.

8. The system of claim 7, wherein the heating device further comprises a fuel injector or a heater.

9. The system of claim 1, wherein the at least one movable internal header is disposed within the reaction chamber to facilitate thermal expansion of the plurality of plates.

10. The system of claim 1, wherein an external header is configured to provide the inlet to the incoming gas flow and the outlet to an outgoing gas flow respectively.

11. The system of claim 1, wherein the reaction chamber further comprises at least one vertical baffle oriented parallel to the terminating end of the plurality of channels and configured to guide the flow of the reacting gas inside the reaction chamber.

12. The system of claim 11, wherein the plurality of plates originate from the at least one horizontal baffle and the at least one vertical baffle.

13. The system of claim 1, wherein the at least one horizontal baffle is centrally disposed at an alternating end of the plurality of channels.

14. The system of claim 1, wherein ends of the channels are formed such that a plane cutting a cross sectional area of the ends of the channels are oriented at an angle less than about 90° relative to the direction of the flow to increase cross-sectional flow area into or out of the channels.

15. A reaction chamber for a heat exchanging system comprising:

at least one movable internal header configured to facilitate thermal expansion of a plurality of plates wound spirally around the reaction chamber; and at least one horizontal baffle configured to partition the at least one movable internal header thereby providing an inlet to an incoming gas flow and an outgoing vent to an outgoing gas flow within the reaction chamber.

16. The reaction chamber of claim 15, comprising at least one vertical baffle oriented along a direction of flow of the reacting gas flow, the vertical baffle configured to guide the flow of the reacting gas inside the reaction chamber.

17. The reaction chamber of claim 16, wherein a plurality of plates originate from the at least one horizontal baffle and the at least one vertical baffle, the plurality of plates wound spirally around the reaction chamber, forming a plurality of channels terminating within the reaction chamber.

18. The reaction chamber of claim 17, wherein the at least one horizontal baffle is centrally disposed at an alternating end of the plurality of channels.

* * * * *

UNITED STATES PATENT AND TRADEMARK OFFICE

CERTIFICATE OF CORRECTION

PATENT NO. : 8,721,981 B2
APPLICATION NO. : 12/627059
DATED : May 13, 2014
INVENTOR(S) : Freund et al.

It is certified that error appears in the above-identified patent and that said Letters Patent is hereby corrected as shown below:

In the Specification

In Column 3, Line 36, delete "second fluid 26" and insert -- second fluid 15 --, therefor.

In Column 3, Line 46, delete "exhaust fluid 15" and insert -- exhaust fluid 26 --, therefor.

In the Claims

In Column 7, Line 23, in Claim 1, delete "comprising;" and insert -- comprising: --, therefor.

Signed and Sealed this
Twenty-ninth Day of July, 2014

Michelle K. Lee

Michelle K. Lee
*Deputy Director of the United States Patent and Trademark Office*